US012262795B2

(12) United States Patent
Monk

(10) Patent No.: US 12,262,795 B2
(45) Date of Patent: Apr. 1, 2025

(54) WHEEL HOUSING WITH REMOVABLE WHEEL COVER FOR PLACEMENT OF DEPLOYABLE WHEEL MEMBER WITHIN DEDICATED MULTI-FUNCTIONAL FOOTWEAR

(71) Applicant: HEELBILLY BOOTS, Nashville, TN (US)

(72) Inventor: Christopher Monk, Kenna, WV (US)

(73) Assignee: HEELBILLY BOOTS, Nashville, TN (US)

( * ) Notice: Subject to any disclaimer, the term of this patent is extended or adjusted under 35 U.S.C. 154(b) by 4 days.

(21) Appl. No.: 18/078,029

(22) Filed: Dec. 8, 2022

(65) Prior Publication Data

US 2023/0413951 A1 Dec. 28, 2023

Related U.S. Application Data

(60) Provisional application No. 63/287,247, filed on Dec. 8, 2021.

(51) Int. Cl.
*A43C 19/00* (2006.01)
*A63C 17/20* (2006.01)

(52) U.S. Cl.
CPC ..... *A43C 19/00* (2013.01); *A63C 17/20* (2013.01)

(58) Field of Classification Search
CPC ..... A63C 17/008; A63C 17/20; A63C 17/08; A43B 5/1641
See application file for complete search history.

(56) References Cited

U.S. PATENT DOCUMENTS 2,095,942 A * 10/1937 Wetterstrand ..... A63C 17/18 280/841
2001/0019195 A1* 9/2001 Adams ..... A63C 17/008 280/11.221

* cited by examiner

*Primary Examiner* — Sharon M Prange
*Assistant Examiner* — Grady Alexander Nunnery
(74) *Attorney, Agent, or Firm* — Volpe Koenig

(57) ABSTRACT

A device configured for use within a dedicated footwear is provided comprising a wheel housing, a removable wheel cover, and a deployable wheel member for multi-dimensional functionality of the footwear. The wheel housing may reside within the heel portion of the sole of the footwear. The removable wheel cover may cover the wheel housing within the heel portion of the dedicated footwear, so that a user may optionally cover the wheel housing when wearing the footwear without the wheel functionality. In addition, the removable wheel cover may optionally be removed from the wheel housing, so that the user may insert the deployable wheel member within the wheel housing, so that the dedicated footwear provides rolling functionality. A user may easily remove the deployable wheel member from the wheel housing to cover the wheel housing with the removable wheel cover and return the footwear to traditional use without the rolling functionality.

4 Claims, 6 Drawing Sheets

WHEEL HOUSING WITH REMOVABLE WHEEL COVER FOR PLACEMENT OF DEPLOYABLE WHEEL MEMBER WITHIN DEDICATED MULTI-FUNCTIONAL FOOTWEAR

CROSS REFERENCE TO RELATED APPLICATIONS

This application claims the benefit of U.S. Provisional Application No. 63/287,247, filed on Dec. 8, 2021, the contents of which are incorporated by reference as if fully set forth herein.

FIELD OF INVENTION

The present invention relates generally to footwear with wheels, and more particularly to a customizable footwear having a wheel housing with removable wheel cover configured for use with a deployable wheel member to provide a user with multi-dimensional functionality of the footwear.

BACKGROUND

In the area of footwear containing wheels within the heel portion of the soles of the boot or shoe for the recreation use and enjoyment by the user, customizing such footwear so that it may be worn alternatively with or without the wheels is desirable, yet in current practice, the combination of this functionality is unavailable in the same piece of footwear. Accordingly, it would be advantageous to implement a customizable boot or shoe for the integration of variable functionality in the same footwear, such that the user can choose between wearing such footwear with or without the wheels in the sole of the boot.

SUMMARY

There is provided according the embodiments of the invention a device configured for use within a dedicated footwear comprising a wheel housing, a removable wheel cover, and a deployable wheel member for multi-dimensional functionality of the footwear. The wheel housing may reside within the heel portion of the sole of a footwear that is dedicated to the multi-functional use by a user. The removable wheel cover may cover the wheel housing within the heel portion of the dedicated footwear, so that a user may optionally cover the wheel housing when the user wishes to wear the footwear without the wheel functionality. In addition, a user may optionally remove the removable wheel cover from the wheel housing when the user wishes to insert the deployable wheel member within the wheel housing in the heel of the footwear, so that the dedicated footwear may provide the rolling functionality when the footwear is worn by the user. The wheel member and wheel housing are further configured so that a user may easily insert the deployable wheel member into the wheel housing, such that the wheel member is securely maintained and held within the wheel housing when the dedicated footwear is worn by the user. Likewise, the wheel member and wheel housing are also configured so that a user may easily remove the deployable wheel member from the wheel housing, such that the user may also cover the wheel housing with the removable wheel cover to return to footwear to traditional use without the rolling functionality.

These and other objects, features and advantages of the present invention will be apparent from the following detailed description of illustrative embodiments thereof, which is to be read in connection with the accompanying drawings.

BRIEF DESCRIPTION OF THE DRAWINGS

The present invention is illustrated by way of example, and not by way of limitation, in the figures of the accompanying drawings in which.

DETAILED DESCRIPTION

Figure 1A:
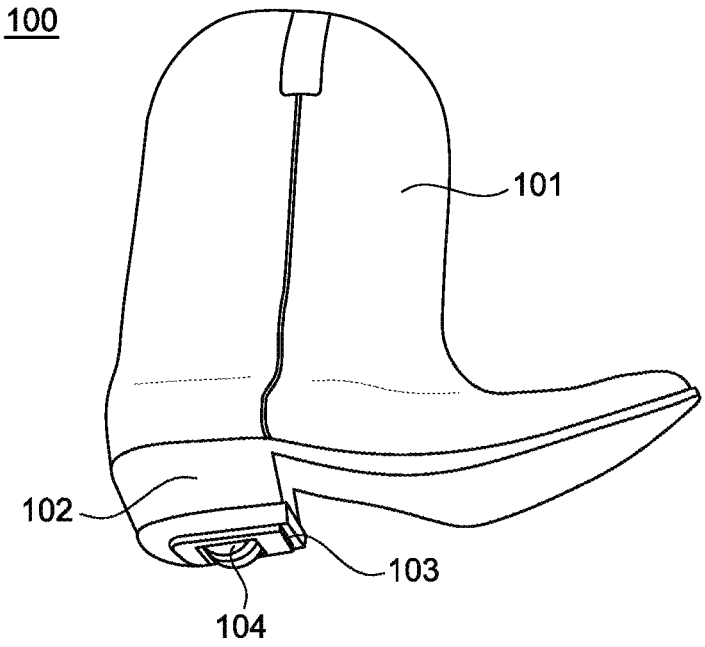
FIG. 1A is a perspective view of an embodiment showing a boot with heel portion comprising the deployable wheel member deployed within the wheel housing.

Various embodiments are described in the following paragraphs. Where like elements have been depicted in multiple embodiments, identical or similar reference numerals have been used for ease of understanding.

In general, traditional footwear features a sole including a heel portion that may support or cushion the heel of a user during routine use. Traditional footwear may also include the implementation of one or more wheels that are permanently affixed within the heel portion of the sole, so that such footwear is intended exclusively for entertainment purposes. For example, children's shoes with wheels in the heel portion are known for providing fun and amusement based upon the roller capability of such footwear.

Currently, footwear including wheels within the heel portion are only designated for roller capability. A customizable footwear having a heel portion configured for use with or without a wheel member may enable a user to utilize the footwear for entertainment purposes and efficient mobility when the wheel is deployed within the heel. Likewise, the user may also utilize such footwear traditionally when the user opts not to deploy the wheel member within the heel.

In particular, a dedicated footwear comprising a wheel housing, a removable wheel cover, and a deployable wheel member for multi-dimensional functionality of the footwear would enhance a user's ability to achieve variable functionality in the same footwear, such that the user can choose between wearing such footwear with or without the wheels in the heel of the footwear. Such footwear may be a boot, similar to a cowboy boot, for example, so that a user may enjoy the boot traditionally without the rolling capability provided by the deployable wheel member, and the user can likewise optionally enjoy the same boot for entertainment purposes when the deployable wheel member is implemented within the heel of the boot.

The deployable wheel member of the dedicated footwear with the wheel housing and removable wheel cover may be deployable and retractable, in that it may easily be attached and removed from the heel portion of the footwear, such as the heel portion of a boot, for example. To deploy the deployable wheel member within the heel of a boot, a user may simply clip or snap the deployable wheel member into place within an opening in the sole of the heel portion that is provided by the wheel housing. A user may choose when to deploy and utilize one or more wheels of the deployable wheel member for skating rather than walking.

When the user chooses to utilize the dedicated footwear with the wheel housing and removable wheel cover to walk rather than skate, the deployable wheel member may be retracted from the wheel housing through the opening in the sole in the heel portion of the boot. Then, the removable wheel cover may be applied to plug and cover the opening in the sole of the heel portion. As aforementioned, the wheel housing provides the opening into the sole of the heel portion, so that when the removable wheel cover is inserted and plugged in to fill the opening provided within the heel by the wheel housing, the opening may then be filled and covered, so that the user may wear the boot traditionally and comfortably for walking rather than skating.

Further, the dedicated footwear comprising a wheel housing, a removable wheel cover, and a deployable wheel member for multi-dimensional functionality of the footwear may also be configured to provide a proper balance and level between the heel and the sole of the footwear. For example, in order for the dedicated footwear, such as a cowboy boot, to be in proper balance, the lowest part of the heel portion that touches the ground and the lowest part of the outsole that touches the ground (i.e, the area located just under the ball of the foot) may be configured to be even and level with each other. In the embodiments disclosed herein, the dedicated footwear, such as a cowboy boot, may be configured such that balance between the lowest part of the heel portion that touches the ground and the lowest part of the outsole that touches the ground is maintained, while the deployable wheel member is deployed within the heel of the boot. In the embodiments disclosed herein, the deployable wheel member within the heel portion of the boot may be the lowest part of the heel portion. The deployable wheel member may therefore provide for a higher heel that can be balanced simply by providing a thicker outsole. Accordingly, in the embodiments disclosed herein, the dedicated footwear, such as a cowboy boot, may achieve proper balance and also provide the boots a longer sole life, which may be desirable due to the scooting and sliding action that the boot may endure when the deployable wheel member within the boots is utilized for skating functionality.

As you might have already realized, the boot will no longer be in balance with the wheels out and the plug in. I made this decision based on comfortability. Having the heel just a bit lower than the outsole while casually walking with the wheels out and the plug in, will be almost unnoticeable compared to having the heel higher than the outsole resulting in the toes of the feet being pushed into the toe of the boot.

Referring to FIG. 1A, a side view of a dedicated footwear 100 is depicted that provides for the integration of variable functionality in the same footwear, such that the user can choose between wearing such footwear 100 with or without the wheels in the sole of the footwear 100. As shown in the embodiment of FIG. 1, the dedicated footwear 100 is illustrated as a boot. However, it is understood that various types of footwear, including sneakers and other dress shoes and boots may be implemented to include the variable functionality of the embodiments disclosed herein.

As shown in FIG. 1A, the footwear 100 depicted is a boot 101 having a heel portion 102 including a sole 103. A deployable wheel member 104 protrudes through the sole 103 of the heel portion 102. The structure of the wheel housing, the removable wheel cover, and the wheel window in relation to their structure within the boot 101 with wheel member 104, sole 103, and heel portion 102 will be described in further detail in the additional embodiments provided herein.

Figure 1B:
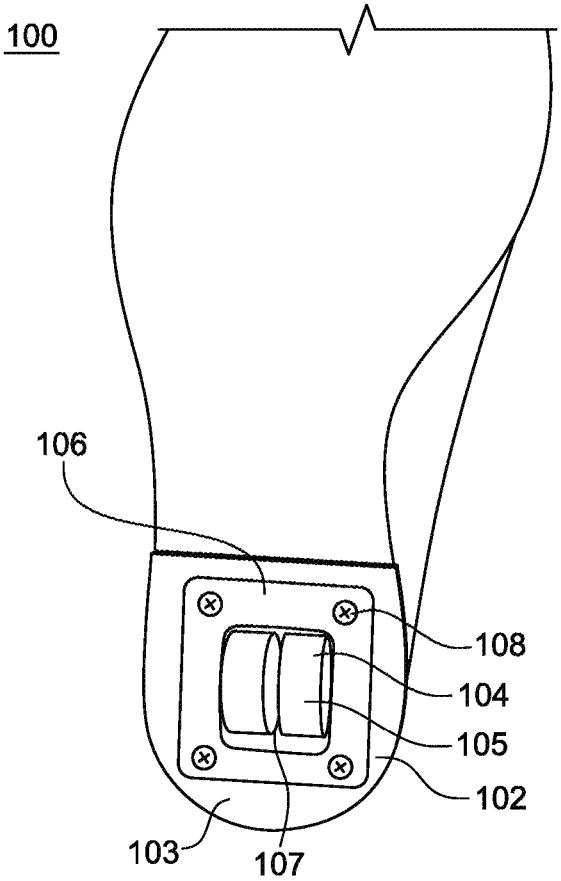
FIG. 1B is an additional perspective view of an embodiment showing a boot with heel portion comprising the deployable wheel member deployed within the wheel housing and wheels protruding through a removable wheel window.

Referring to FIG. 1B, the bottom of the boot 101 is shown with the sole 103 and heel portion 102. Within the sole 103 of the heel portion 102 resides the deployable wheel member 104 with at least one wheel 105. Although the wheel housing is not visible in FIG. 1B, the wheel housing is disposed within the heel portion 102 and houses the deployable wheel member 104. Once the deployable wheel member 104 is inserted by a user into the wheel housing through the opening in the sole 103 and heel portion 102 of the boot 101, the user may simply clip or snap the deployable wheel member 104 into place within the wheel housing. Although the embodiment of FIG. 1B illustrates optional screws 108 that may be utilized to secure the wheel housing with deployable wheel member 104 within the heel portion 102 of the boot 101, it is understood that in other embodiments, the wheel housing with deployable wheel member 104 may be secured within the heel portion 102 of the boot 101 without screws 108. As will be described in further detail, in some embodiments, the deployable wheel member 104 may optionally be snapped or clipped into place within the wheel housing inside the sole 103 and heel portion 102.

Referring again to FIG. 1B, the bottom of the boot 101 is shown with the sole 103 and heel portion 102 may optionally further include a wheel window 106 configured to attach to the sole 103 of the heel portion 102 when the deployable wheel member 104 is deployed within the wheel housing. The removable wheel window 106 may feature a hole 107 to allow the at least one wheel 105 of the deployable wheel member 104 to protrude out of the hole 107 through the removable wheel window 106. In an embodiment, the removable wheel window 106 may optionally be fastened to the sole 103 of the heel portion 102 via screws 108. It is understood that in other embodiments, other mechanical modalities may be utilized to attached the wheel window 106 to the sole 103 of the heel portion 102, such as snapping or clipping the wheel window 106 into place within the sole 103 of the heel portion 102.

Figure 2A:
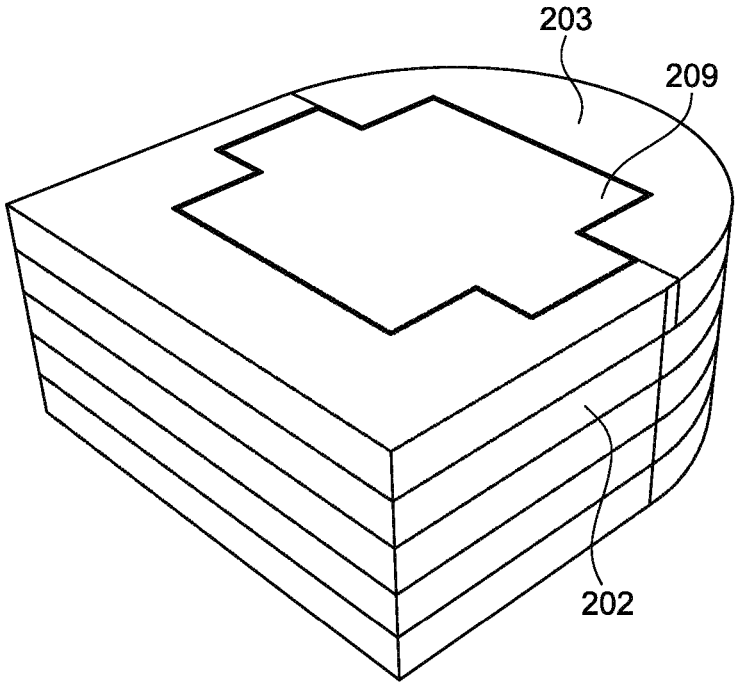
FIG. 2A is a perspective view of an embodiment showing a heel portion of a boot with a removable wheel cover inserted into the opening of the wheel housing within the sole of the heel.
Figure 2B:
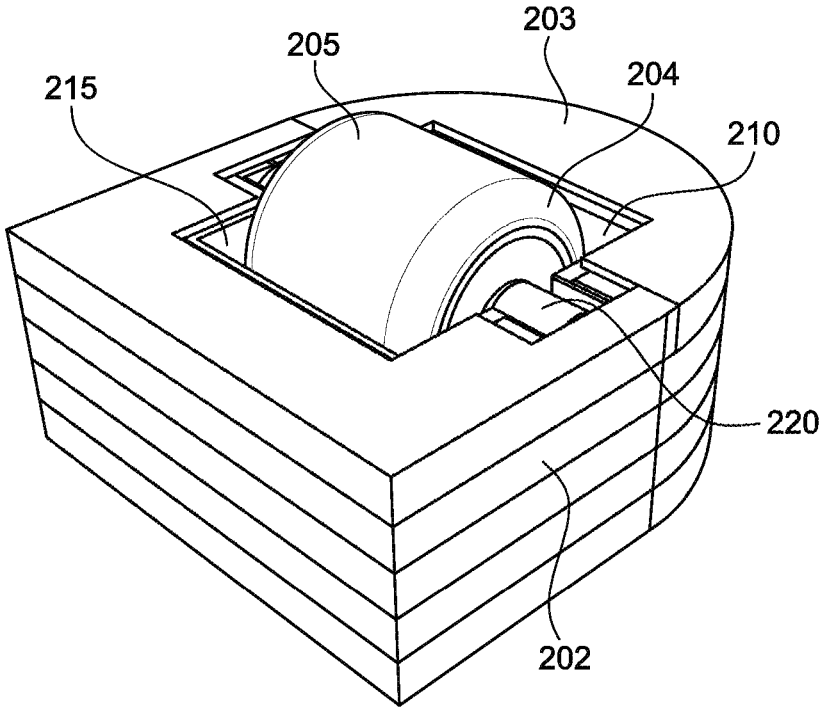
FIG. 2B is a perspective view of an embodiment showing a heel portion of a boot with a deployable wheel member deployed within the wheel housing in the sole of the heel.

Referring to FIGS. 2A and 2B, perspective views of the sole 203 of the heel portion 202 of the bottom of the boot 101 of FIGS. 1A and 1B are shown. As depicted in FIG. 2A, a removable wheel cover 209 is illustrated, which may be applied to plug and cover the opening 215 (shown in FIG. 2B) in the sole 203 of the heel portion 202. The wheel housing 210 (shown in FIG. 2B) provides the opening 215 into the sole 203 of the heel portion 202, so that when the removable wheel cover 209 is inserted and plugged in to fill the opening 215 provided within the heel portion 202 by the wheel housing 210, the opening 215 may then be filled and covered, so that the user may wear the boot 101 traditionally and comfortably for walking rather than skating. The wheel housing 210 may optionally be secured within the heel portion 202 of the sole 203 by a stacked heel layering configuration of the heel portion 202 of the boot 101, as shown in FIG. 2A.

Referring to FIG. 2B, the deployable wheel member 204 deployed within the wheel housing 210 may be both deployable and retractable. More particularly, the deployable wheel member 204 may easily be attached and removed from the heel portion 202 of the boot 101. To deploy the deployable wheel member 204 within the heel portion 202 of the boot 101, a user may clip or snap the deployable wheel member 204 into place within the opening 215 in the sole 203 of the heel portion 202 that is provided by the wheel housing 210. A user may choose when to deploy and utilize the deployable wheel member 204 for skating rather than walking. With respect the one or more wheels 205 of the deployable wheel member 204, it is understood that various materials including urethane are contemplated for purposes of providing wheels 205 having an appropriate durability for rolling on both smooth an rough surfaces when the deployable wheel member 204 is deployed within the wheel housing 210.

Referring again to FIG. 2B, the deployable wheel member 204 may further include an axel 220, which maintains the position of the wheel member 204 with one or more wheels 205 within the wheel housing 210 inside the heel portion 202 of the boot 101. As will be described in further detail, the wheel member 204 may include additional components such as a wheel spacer and bearings to retain and the position of the one or more wheels 205 inside the wheel housing 210. In an embodiment, the axel 220 may feature spring pins on each end of the axel 220 that accommodate a user's ability to deploy and retract the deployable wheel member 204 via clipping or snapping the deployable wheel member 204 into place within the opening 215 in the sole 203 of the heel portion 202 that is provided by the wheel housing 210.

Referring again to FIGS. 2A and 2B, when the user chooses to utilize the boot 101 with the wheel housing 210 and removable wheel cover 209 for walking rather than rolling and skating functionality, the deployable wheel member 204 may be retracted from the wheel housing 210 through the opening 215 in the sole 203 in the heel portion 202 of the boot 101. Then, the removable wheel cover 209 (shown in FIG. 2A) may be applied to plug and cover the opening 215 in the sole 203 of the heel portion 202. As aforementioned, the wheel housing 210 provides the opening 215 into the sole 203 of the heel portion 202, so that when the removable wheel cover 209 is inserted and plugged in to fill the opening 215 provided within the heel 202 by the wheel housing 210, the opening 215 may then be filled and covered, so that the user may wear the boot 101 to walk rather than to skate. In an embodiment, the wheel housing 210 may optionally be secured within the heel portion 202 of the sole 203 by a stacked heel layering configuration of the heel portion 202 of the boot 101, as shown in FIG. 2B.

Figure 3:
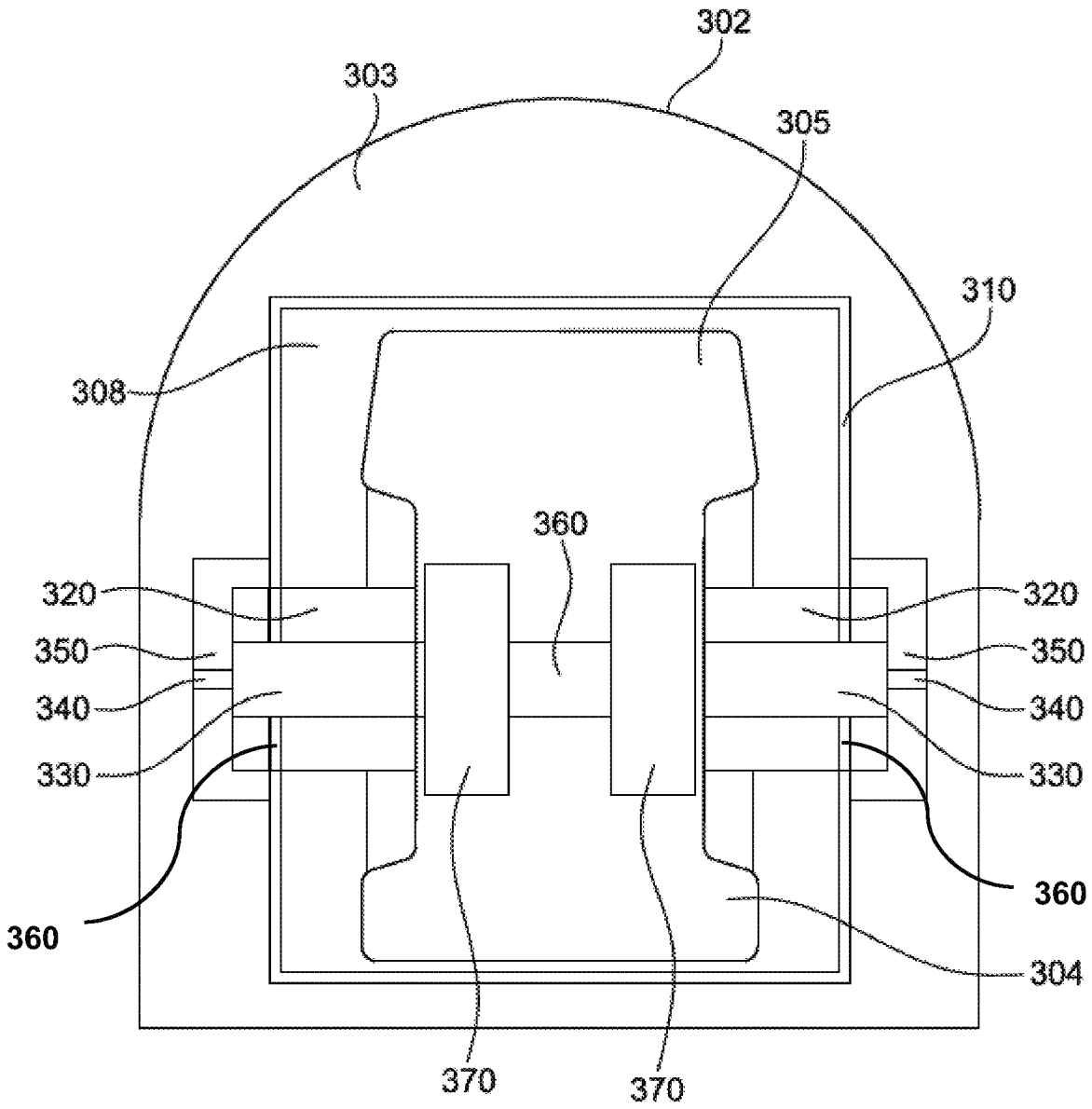
FIG. 3 is a cross-sectional view of a heel portion of a boot with a deployable wheel member deployed within the wheel housing in the sole of the heel.

In reference to FIG. 3 showing a cross-sectional view of a heel portion 302 of a boot 101 with a deployable wheel member 304 deployed within the wheel housing 310 in the sole 303 of the heel portion 302, the components of the deployable wheel member 304 are illustrated in further detail. The wheel housing 310 provides a recessed space 308 within the heel portion 302, so that the deployable wheel member 304 may reside within the recessed space 308 provided by the wheel housing 310.

Referring again to FIG. 3, the component parts of the deployable wheel member 304 within the wheel housing 310 may include the axel 320 with inner portion 330 extending through both sides of the wheel 305. Pins 340 may extend from each end of the inner portion 330 of the axel 320 and provide an attachment mechanism for the deployable wheel member 304 with the inner wall 350 of the wheel housing 310. In an embodiment, the pins 340 located on each end of the inner portion 330 of the axel 320 may feature a spring mechanism that accommodates a user's ability to deploy and retract the deployable wheel member 304 via clipping or snapping the deployable wheel member 304 into place within the wheel housing 210. A user may quickly and easily couple the pins 340 of the deployable wheel member 304 to the inner wall 350 of the wheel housing 310 to secure the deployable wheel member 304 within the heel portion 302. The pins 340 may allow the deployable wheel member 304 to be both deployed within and retracted from the wheel housing 310 so that the user may seamlessly enjoy the dual functionality of the boot 101.

In further reference to FIG. 3, the deployable wheel member 304 may feature a wheel spacer 360 and bearings 370 that facilitate the stability and rotation of the wheel 305 of the deployable wheel member 304 within the wheel housing 310. Although FIG. 3 illustrates one wheel 305 in the deployable wheel member 304, it is understood that additional configurations of the wheel member 304 may be contemplated including more than one wheel 305 in the wheel member 304.

Figure 4:
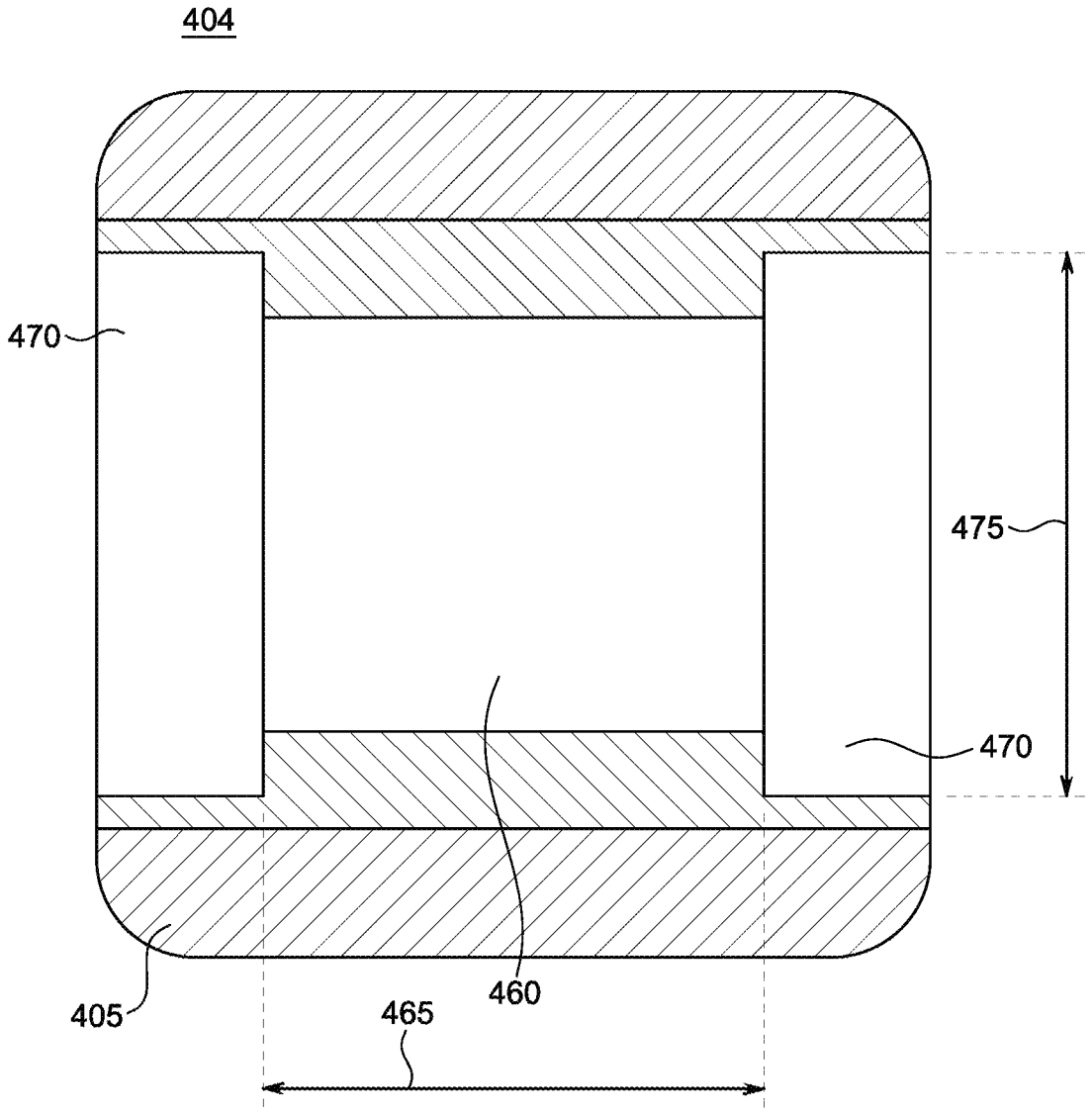
FIG. 4 is a plan view of an embodiment of a deployable wheel member that may be deployed within a wheel housing within a sole of a boot heel.

Referring to FIG. 4 in conjunction with FIGS. 2B and 3, a plan view of an embodiment of a deployable wheel member 204, 404 (as shown in FIG. 2B) is shown that may be deployed within a wheel housing 210 within a sole 203 of a boot heel 202. The deployable wheel member 404 as shown in FIG. 4 may include a wheel spacer 360, 460 and bearings 370, 470 that facilitate the stability and rotation of the wheel 305, 405 of the deployable wheel member 304, 404 within the wheel housing 310 (also shown in FIG. 3).

Referring again to FIG. 4, in an embodiment, the deployable wheel member 404 may feature a wheel spacer 460 having a length 465 of approximately 15 mm and bearings 470 having a height 475 of approximately 16.4 mm. It is understood that an axel 320 as shown in FIG. 3 may extend through the deployable wheel member 404. In particular, the axel 320 may extend through the wheel spacer 460 and through the bearings 470, so that the axel 320 protrudes out of the deployable wheel member 404 on each side adjacent to the bearings 470. Although not shown in FIG. 4, it is further understood that an axel 320 as shown in FIG. 3 that is disposed within the deployable wheel member 404 may also feature pins 340, as shown in FIG. 3. As aforementioned, pins 340 may extend from each end of the inner portion 330 of the axel 320 and provide an attachment mechanism for the deployable wheel member 304, 404 with the inner wall 350 of the wheel housing 310.

Figure 5:
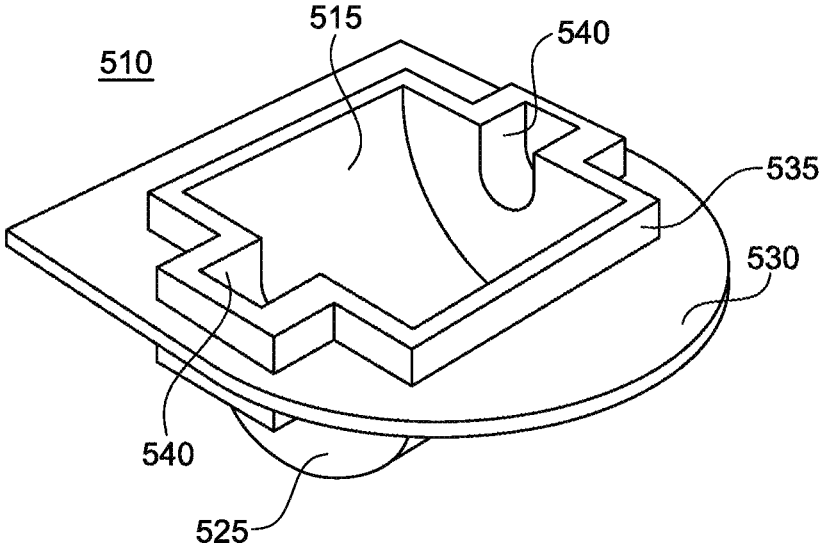
FIG. 5 is a perspective view of the wheel housing that resides within the heel portion of a boot.

Referring to FIG. 5, a perspective view of the wheel housing 510 is shown. The wheel housing 510 may feature a recessed space 515 to house a deployable wheel member 204 (as shown in FIG. 2B). The wheel housing 510 may further include a base portion 525 that extends into the sole 203 of the heel portion 202 of a boot 101. A top portion 530 may be flush with the sole 203 of the heel portion 202 of a boot 101 when the wheel housing 510 is disposed within the heel portion 202 of a boot 101. It is understood that the heel portion 202 of a boot 101 including the component parts of the wheel housing 510 may be configured so that the heel portion 202 may accommodate the dimensions and structure of the wheel housing 510, so that the wheel housing 510 is contained within the heel portion 202 of a boot 101.

Referring again to FIG. 5, in an embodiment, the wheel housing 510 may include a retaining wall 535 that further assists to house a deployable wheel member 204 when the deployable wheel member 204 is deployed within the wheel housing 510. In addition, the wheel housing 510 may further include a grooves 540 to support a deployable wheel member 204. More specifically, the grooves 540 may receive the axel 320 (as shown in FIG. 3). In an embodiment, the grooves 540 may receive the inner portion 330 of the axel 320, including the pins 340 extending from each end of the inner portion 330 of the axel 320. The grooves 540 may facilitate the attachment of the deployable wheel member 304 to the wheel housing 510 within the retaining wall 535.

Referring to FIG. 5 in conjunction with FIG. 2A, the wheel housing 510 provides an opening and recessed space 515 within the sole 203 of the heel portion 202, so that the deployable wheel member 204 (as shown in FIG. 2B) may be deployed within the wheel housing 510 within the heel portion 202. When a user chooses to retract the deployable wheel member 204 from the wheel housing 510 in order to wear the boots 101 traditionally for walking, the removable wheel cover 209 (as shown in FIG. 2A) may be inserted and plugged in to fill and cover the opening and recessed space 515 within the sole 203 of the heel portion 202 provided by the wheel housing 510, so that the user may wear the boots 101 to walk rather than to skate.

Referring to FIG. 5 in conjunction with FIG. 2B, as aforementioned, the wheel housing 210, 510 resides within the heel portion 202 and houses the deployable wheel member 204 (as shown in FIG. 2B). The wheel housing 210, 510 provides a recessed space 215, 515 within the heel portion 202, so that the deployable wheel member 204 may reside within the recessed space 215, 515 provided by the wheel housing 210, 510. When a user chooses to wear the boots 101 for skating functionality, the deployable wheel member 204 may be deployed within the wheel housing 210, 510. In particular, the deployable wheel member 204 may be deployed within the wheel housing 210, 510 when a user clips or snaps the deployable wheel member 204 into place within the recessed space 515 of the wheel housing 210, 510.

Figure 6:
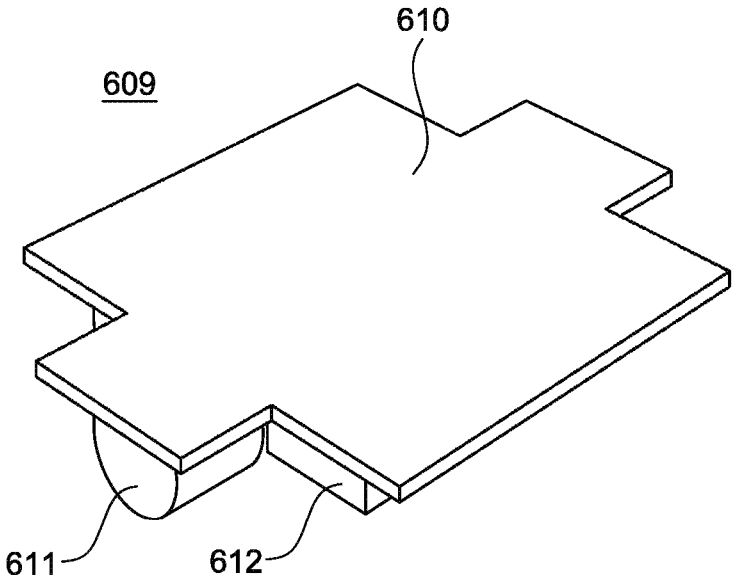
FIG. 6 is a perspective view of the removable wheel cover that may plug into and fit within the wheel housing within the heel portion of a boot.

Referring to FIG. 6, in conjunction with FIGS. 2A and 2B, a perspective view of the removable wheel cover 209, 609 is shown. When a user chooses to retract the deployable wheel member 204 from the wheel housing 510 in order to wear the boots 101 traditionally for walking, the removable wheel cover 209, 609 may be inserted and plugged in to fill and cover the opening and recessed space 215, 515 within the sole 203 of the heel portion 202 provided by the wheel housing 510, so that the user may wear the boots 101 to walk rather than to skate. When the removable wheel cover 209, 609 is inserted and plugged into the recessed space 215, 515 within the sole 203 of the heel portion 202, the top portion 610 of the removable wheel cover 209, 609 may be flush with the sole 203 of the heel portion 202 of a boot 101.

Referring again to FIG. 6, the removable wheel cover 209, 609 may also feature a rounded portion 611 that may plug into a fit within the grooves 540 of the wheel housing 510 (as shown in FIG. 5). As such, the lower structure 612 of the removable wheel cover 209, 609, including the rounded portion 611 that may plug into a fit within the grooves 540 of the wheel housing 510, accommodates the contours of the wheel housing 510 in order to enable a user to wear the boots 101 traditionally for walking. When the removable wheel cover 209, 609 is plugged into and inserted into the recessed space 215, 515 within the sole 203 of the heel portion 202 provided by the wheel housing 510, the removable wheel cover 209, 609 may prevent the accumulation of dirt and debris from accumulating within the wheel housing 510.

Figure 7A:
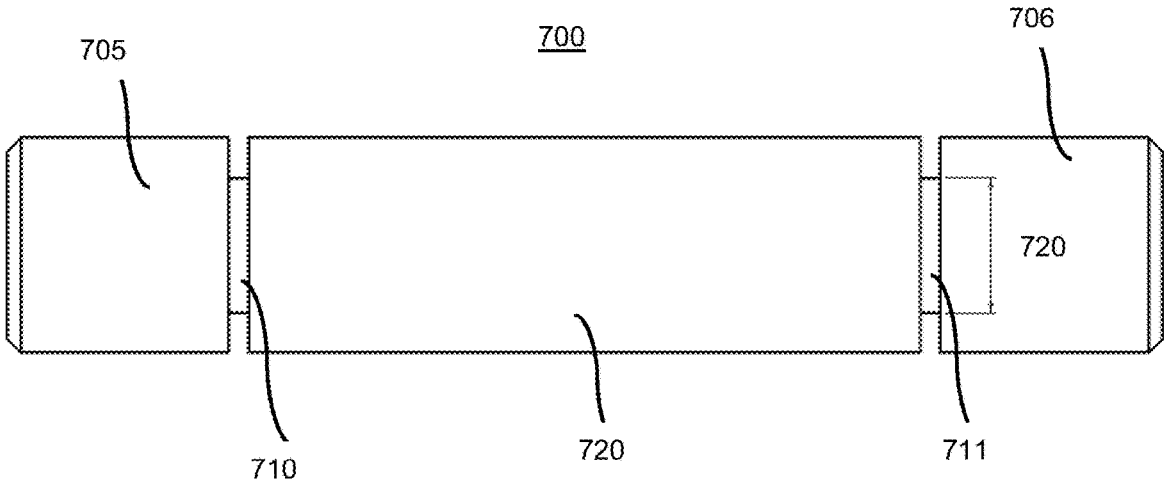
FIG. 7A is a plan view of an axel portion of a deployable wheel member.
Figure 7B:
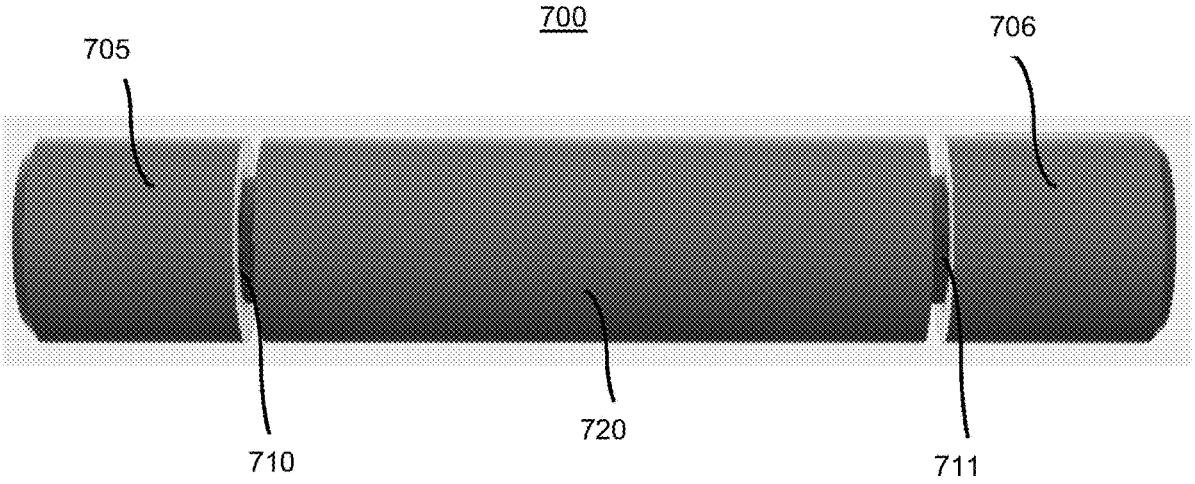
FIG. 7B is a perspective view of an axel portion of a deployable wheel member.

Referring to FIG. 7A and FIG. 7B, a plan view and perspective view of an axel 700 are respectively shown. The axel 700 may maintain the position of the deployable wheel member 204 (as shown in FIG. 2B) with one or more wheels 205 within the wheel housing 210 inside the heel portion 202 of the boot 101. The axel 700 may include a center member portion 720 extending axially from both ends to edge members 705, 706. Between the center member portion 720 and edge members 705, 706 are respective divot portions 710, 711. As shown in FIGS. 7A and 7B, divot portions 710, 711 of the axel 700 may feature a length 720, so that divot portions 710, 711 provide a grove between the center member portion 720 and edge members 705, 706. Although the axel 700 as shown in FIG. 7A is shown with a block shape, it is understood that the axel 700 may feature a cylindrical shape as shown in FIG. 7B.

Referring again to FIGS. 7A and 7B in conjunction with FIG. 2B and FIG. 3, in embodiments in which the deployable wheel member 204, 304 may be snapped or clipped into place within the wheel housing 210, 310 inside the heel portion 202, 302 of the boot 101, the divot portions 710, 711 of the axel 700 may align with edges or grooves 360 (as shown in FIG. 3) of the wheel housing 210, 310. For example, and in reference to FIGS. 7A and 7B in conjunction with FIG. 3, the inner wall 350 of the wheel housing 310 may feature edges or grooves 360 that line up with the divot portions 710, 711 of the axel 700 to secure the deployable wheel member 304 within the heel portion 302. In particular, when the deployable wheel member 204, 304 with axel 700 as shown in FIGS. 7A-7B is placed over the wheel housing 210, 310, an edge or groove 360 of the wheel housing 210, 310 inside the heel portion 202, 302 may line up with the divot portions 710, 711 of the axel 700. When pressed firmly, the deployable wheel member 204, 304 may snap or clip into place onto the edge or groove 360 within the wheel housing 210, 310 securely. It is understood that various embodiments of the wheel housing 210, 310 are contemplated.

Although features and elements are described above in particular combinations, each feature or element can be used alone without the other features and elements or in various combinations with or without other features and elements.

What is claimed is:

1. A boot heel comprising:

a heel body, the heel body comprising a plurality of stacked layers including a top layer, a bottom layer, and middle layers, wherein the top layer of the plurality of stacked layers is configured to interface with a cowboy boot, and wherein the bottom layer of the plurality of stacked layers is a sole layer;

an opening in the sole layer of the heel body;

a wheel housing defining a recessed space contained within the heel body and accessible through the opening in the sole layer;

a deployable wheel member comprising at least one wheel and an axle protruding from either side of the at least one wheel, the deployable wheel member configured for detachable deployment partially recessed within the wheel housing;

wherein the wheel housing comprises grooves configured to receive the axle of the deployable wheel member; and a removable wheel cover having a bottom surface that has a corresponding shape to the opening in the sole layer of the heel body, and a plug structure opposite the bottom surface including rounded portions corresponding to the grooves, wherein the plug structure is configured to fill the recessed space and the rounded portions are configured to plug within the grooves of the wheel housing, and wherein the bottom surface is configured to close the opening in the sole layer of the heel body and be flush with the sole layer when the deployable wheel member is not deployed within the wheel housing.

2. The boot heel of claim 1, wherein the removable wheel cover is configured to unplug from the wheel housing when a user deploys the deployable wheel member within the wheel housing.

3. The boot heel of claim 2, wherein when the deployable wheel member is deployed and partially recessed within the wheel housing, at least one wheel of the deployable wheel member protrudes out of the opening in the sole laver of the heel body.

4. The boot heel of claim 1, wherein the deployable wheel member further comprises pins that couple to an inner wall of the wheel housing to secure the deployable wheel member within the wheel housing.

* * * * *